United States Patent [19]

Braden et al.

[11] 4,223,538

[45] Sep. 23, 1980

[54] REFRIGERATOR COMPARTMENT DIVIDER MOUNTING

[75] Inventors: Ralph S. Braden, Bellbrook; Paul E. Kronenberger, Dayton, both of Ohio

[73] Assignee: White Consolidated Industries, Inc., Cleveland, Ohio

[21] Appl. No.: 5,861

[22] Filed: Jan. 23, 1979

[51] Int. Cl.[2] ..... F25D 11/00

[52] U.S. Cl. ..... 62/443; 62/377; 312/236

[58] Field of Search ..... 62/377, 440, 441, 442, 62/443; 312/214, 236

[56] References Cited

U.S. PATENT DOCUMENTS

| | | | |
|---|---|---|---|
| 3,572,049 | 3/1971 | Moorman | 62/443 |
| 3,599,442 | 8/1971 | Hanson | 62/441 |
| 3,633,374 | 1/1972 | Cantor | 62/377 |
| 4,086,785 | 5/1978 | Kochendorfer et al. | 62/441 |

*Primary Examiner*—Ronald C. Capossela

*Attorney, Agent, or Firm*—Pearne, Gordon, Sessions

[57] ABSTRACT

An improved refrigerator partition bottom closure support frame assembly comprising a pair of side wall sections and a rear wall section whereby the closure may be slidably removed and reinstalled without removal of the closure support. The support frame provides concealed adjustment gaps compensating for tolerance and manufacturing variations so as to reduce assembly time and improve the appearance of the refrigerator.

1 Claim, 7 Drawing Figures

REFRIGERATOR COMPARTMENT DIVIDER MOUNTING

This invention relates to two compartment refrigerator construction and more particularly to an improved support frame assembly removably supporting an upper closure of a partition assembly separating the upper freezer and the lower fresh food storage compartments of the refrigerator.

Refrigerators in which refrigeration system components, such as the cooling coil and fan motor, are located in a cavity of a partition assembly separating the upper freezer and lower fresh food compartments including a freezer bottom or closure overlying the cavity are known. See, for example, the U.S. Pat. No. 3,599,442 issued Aug. 17, 1971 to R. S. Hanson and assigned to the same assignee as the present application. Heretofore, servicing of the system components in the partition cavity required the disassembly of a relatively large number of interconnected parts to remove the partition cavity closure. In the manufacture and servicing of such two compartment refrigerators it was realized that waste of labor and materials would be avoided if an improved construction for removably supporting the closure in a ready manner were provided as opposed to the disassembly of such parts.

It is therefore an object of the present invention to provide an improved two compartment refrigerator partition assembly system components space closure mounting arrangement comprised of a three-sectioned support frame assembly formed with channels suitable to receive the closure planar shelf portion side and rear edges to allow the closure forward portion to deform permitting disengagement thereof from the frame assembly enabling the side and rear edges of the closure shelf portion to be free for sliding movement in the channels without the disassembly of the support frame assembly.

It is a further object of the present invention to provide an improved closure support frame assembly as set forth in the above object wherein first and second mirror image sidewall sections of the frame assembly, together with a rear wall section, define at least one adjustment gap whereby refrigerator one-piece liners of varying interior tolerance dimensions between their side walls may be adjustably accommodated by the gap, and whereby one of the wall sections includes a wing extending beyond a free end thereof, such that the section wing telescopically overlaps a portion of an adjacent section to conceal such adjustment gap.

Further objects and advantages of the present invention will be apparent from the following description, reference being had to the accompanying drawings wherein a preferred embodiment of the present invention is clearly shown.

Figure 1:
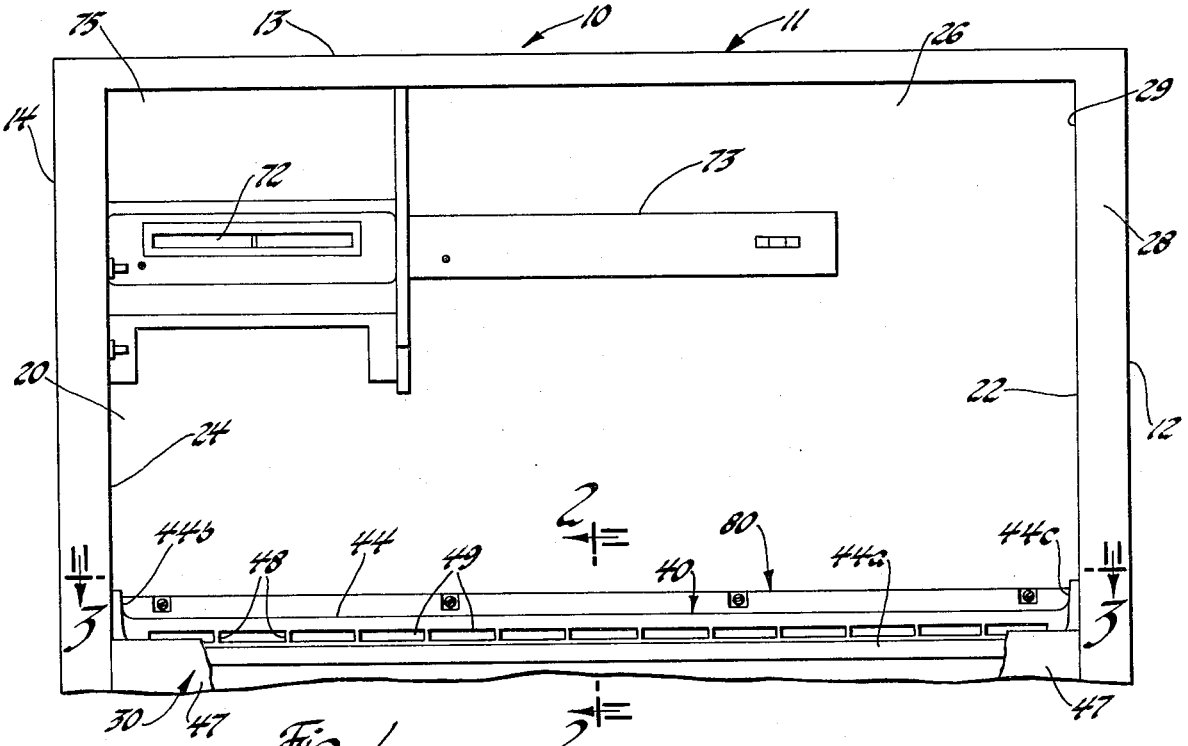
FIG. 1 is a fragmentary front elevational view of the top freezer compartment of a two compartment domestic refrigerator with the access doors removed.
Figure 2:
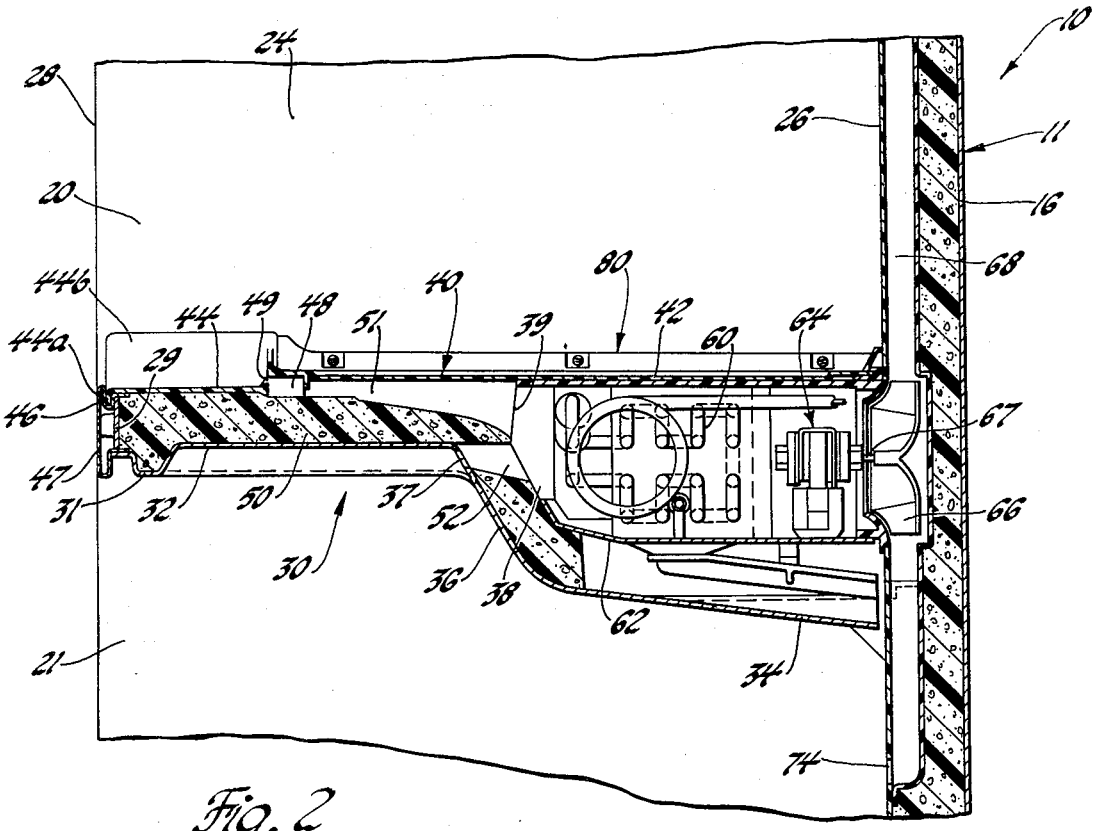
FIG. 2 is a fragmentary vertical sectional view of the refrigerator showing the divider or partition taken substantially along the line 2—2 of FIG. 1.

Referring now to the drawings and more particularly to FIGS. 1 and 2, there is illustrated the upper portion of a top freezer refrigerator cabinet, generally indicated at 10, including an outer metal shell 11 with the visible portions including righthand outer sidewall 12, top outer wall 13, lefthand outer sidewall 14 and outer back wall 16.

The cabinet is provided with an upper freezer compartment 20, and a lower fresh food or cooling compartment 21, both being enclosed within an inner one-piece liner preferably formed of suitable sheet plastic such as acrylic butadiene styrene copolymer with the liner right-hand sidewall 22 and lefthand sidewall 24 and rear wall 26 being visible in FIG. 1. The space between the inner or liner walls and the outer metal shell 11 is filled with suitable insulating material which in the preferred form is shown as expanded polyurethane foam. The shell sidewalls 12 and 14 and top wall 13 are reinforced at the front with an inwardly turned flange 28 extending inwardly substantially at right angles to the side and top walls around the access opening for defining the liner front opening. Suitable brackets (not shown) extend through openings in the flange 28 and support a front metal cross member 29 (FIG. 2) extending therebetween. As seen in FIGS. 1 and 2, the upper freezer compartment 21 and lower fresh food compartment 20 are separated by an insulated horizontal divider or partition assembly generally indicated at 30 which includes a lower sheet metal wall 31 forming the bottom of the partition assembly. The wall 31 includes a higher portion 32 at the front and a lower portion 34 at the rear with an inclined or slanted connecting section 36 between the front and rear portions provided with air inlets 37 to a refrigeration system components cavity generally indicated at 38. The cavity 38 is accessible via an upper access opening 39.

A freezer bottom member or closure, generally indicated at 40, provides a cover for the cavity access opening 39. The closure 40 includes an upwardly offset rearward planar shelf portion 42, adapted to support food in the upper freezer compartment 20, and a forward portion 44 overlying partition assembly 30. As seen in FIG. 2, the closure forward portion 44 front edge terminates in a downwardly depending frontal flange or lip **44*a* while its edges terminate in upwardly extending left and right side flanges shown at 44*b* and 44*c* respectively. The closure 40 removably engages the partition assembly adjacent its front edge by means of its frontal lip 44*a* engaging a transverse groove 46 formed in cabinet center trim strip 47 suitably affixed to the front face of the partition 30. The lip 44*a* is removably retained in the groove 46 by suitable fasteners such as barbed U-shaped clips (not shown). Thus, to remove the lip 44*a* from the groove 46 requires the use of a suitable tool, such as a screwdriver. The shelf portion 42 is integrally connected to forward portion 44 in part by a plurality of vertically extending horizontally spaced divider fins 48 defining a series of freezer air exits 49 which are in communication with longitudinally extending return air passages formed in a front insulation member 50 preferably formed of styrofoam insulation. The air passages, one of which is shown at 51 in FIG. 2**, connect with components cavity 38 allowing the warmed freezer compartment air to return to cavity 38. Passage 52 in member 50 provides communication with air inlets 37 allowing warmed air from the fresh food compartment 21 to flow into the cavity 38.

The components cavity 38 in the disclosed form supports a cooling coil or evaporator 60 supported on a drain pan 62. The evaporator 60 is supplied with liquid refrigerant in a conventional manner as shown and described for example, in U.S. Pat. No. 3,633,374, issued Jan. 11, 1972 to James A. Canter and assigned to the assignee of the present application. A fan or blower motor 64 is provided with a front inlet centrifugal blower wheel or impeller 66 on motor shaft 67. The blower wheel draws air through air inlets 37 and 49 into the cavity 38 and through the cooling coil 60 discharging the air upwardly through a duct 68 and outlet 72 via a transverse deflector duct 73 to the ice cube service area 75 of freezer compartment 20. A reduced amount of freezer air is discharged downwardly through the duct 68 into the fresh food compartment 21 through rear wall outlet 74.

Figure 3:
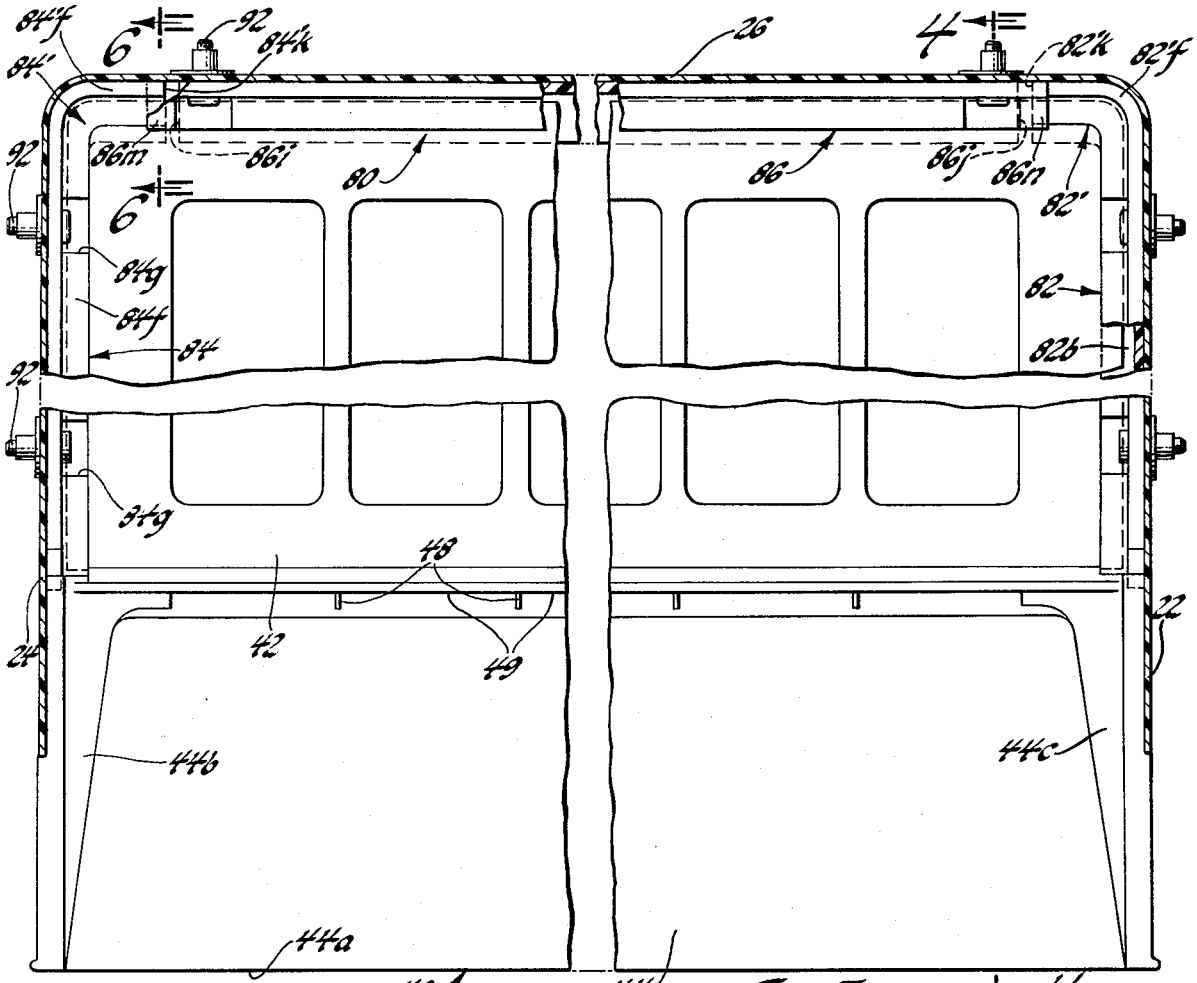
FIG. 3 is a fragmentary horizontal sectional view taken substantially along the line 3—3 of FIG. 1 showing the freezer bottom or closure in elevation.

As best seen in FIG. 3, the closure 40 is supported by a support frame assembly generally indicated at 90, in a slidably removable manner to provide access to the top opening 39 of the components cavity 38. The closure support frame assembly 80 consists of three sections, namely a pair of righthand and lefthand elongated mirror image first and second sidewall sections generally indicated at 82 and 84, respectively, together with a third rear wall section 86. It will be seen that the first 82 and second 84 sidewall sections each have a length substantially coextensive with the longitudinal dimension of the rearward upwardly offset shelf portion 42 with each sidewall section 82, 84 terminating in a substantially right-angle corner portion 82' and 84' respectively. The corner portions 82', 84' are formed with a radiused contour substantially conforming to the arcuate contour of the rear corners of the refrigerator liner.

Figure 4:
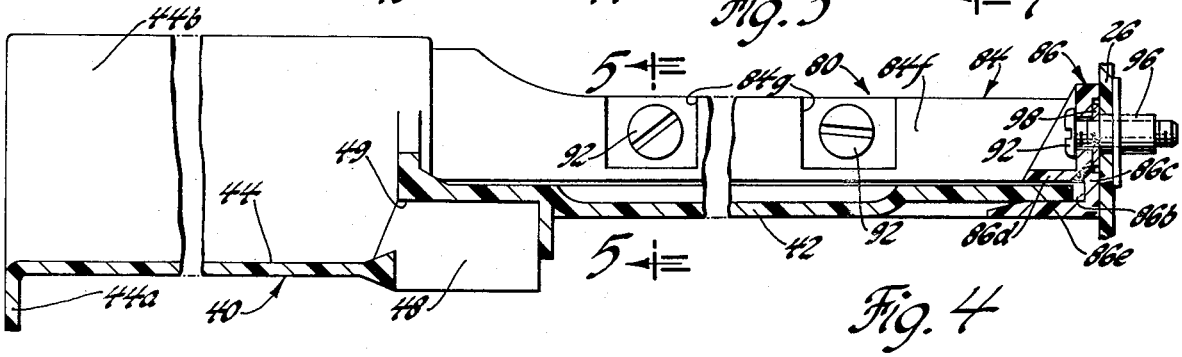
FIG. 4 is a fragmentary vertical sectional view of the closure taken substantially on the line 4—4 of FIG. 3.
Figure 5:
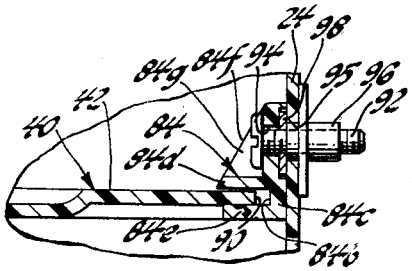
FIG. 5 is a fragmentary vertical sectional view taken substantially along the line 5—5 of FIG. 4.

As best seen in FIGS. 4 and 5, each sidewall section 82, 84 defines an inwardly facing channel 82*b*, 84*b* respectively, adapted to slidably receive and support the associated side edge 90 of the planar rearward shelf portion 42. With reference to FIG. 5 for the sidewall section 84, its channel 84*b* is defined by an integral U-shaped section having a vertically disposed base portion 84*c* and a pair of parallel upper and lower horizontally disposed upper and lower leg portions 84*d* and 84*e*, respectively. Each of the side wall sections 82, 84 is formed with an upwardly and rearwardly extending securing flange 82*f*, 84*f* respectively, coextensive therewith and extending upwardly and rearwardly from the upper edge of its associated upper leg such as leg 84*d* for section 84. The sidewall section securing flanges each include a plurality of spaced notched-out recesses, as exemplified by recess 84*g* in section 84. The recesses are of a size to receive a suitable fastener such as a threaded fastener indicated at 92 shown in FIG. 5 extending through aligned aperture 94 in recess 84*g* and aperture 95 in its associated sidewall. In the disclosed embodiment a suitable flanged sleeve 96 is threadably engaged by a fastener 92, providing retention with washer 98 of the side section 84 to the liner wall 24.

Figure 6:
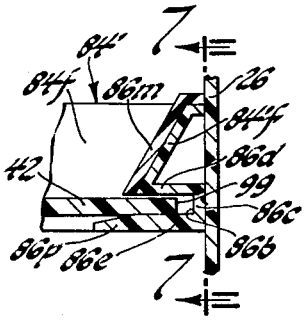
FIG. 6 is a fragmentary vertical sectional view taken substantially along the line 6—6 of FIG. 3.

As best seen in FIGS. 3 and 6, the rear wall section, generally indicated at 86, is substantially identical in section to the sidewall sections 82, 84 including their corner portions 82', 84' respectively, and include a forwardly facing channel 86*b* defined by a base portion 86*c* and upper and lower horizontal leg portions 86*d* and 86*e*. FIG. 3 shows rear wall section 86, having a predetermined length such that its free ends, such as lefthand end 86*i*, (FIG. 7) is positioned in opposed spaced relation with the inwardly facing free end 84'*k* of its associated corner portion 84' defining therebetween an adjustment gap "G". An identical adjustment gap is provided between the right-hand corner portion end 82'*k* and the other end 86*j* of the rear wall section 86. It will be noted that the wall section flange portion 86 includes wings 86*m* and 86*n* extending outwardly beyond each of its free ends 86*i* and 86*j* respectively, so as to extend beyond the free end of the section.

Figure 7:
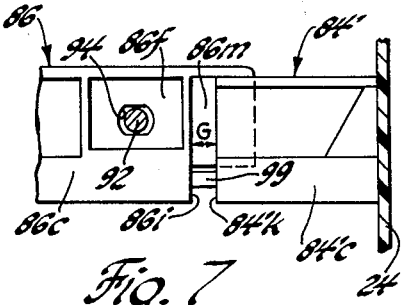
FIG. 7 is a fragmentary elevational view, partly in section, taken on line 7—7 of FIG. 6.

The adjustment gaps "G" are provided at each end of the rear wall section 86 such that one-piece cabinet liners of varying interior tolerance dimensions between their sidewalls may be adjustably accommodated by the gaps "G" of the support frame assembly. As best seen in FIGS. 6 and 7, the rear wall section wing 86*m* is provided with a conforming complementary section to telescopically overlap a portion of the flange 84'*f* of its adjacent corner portion 84' to conceal its associated gap "G" thereby improving assembly and appearance of the partition 30 in the cabinet by allowing for side-to-side liner variations.

It will be appreciated that the forward portion 44 of the closure is upwardly deformable to permit disengagement thereof from the partition assembly such that its lip 44*a* may be freed from groove 46 thus allowing the side and rear edges of the closure shelf portion 42 to be free for sliding movement within the channels 82*b*, 84*b* and 86*b* of the frame assembly. Thus, applicant's assembly permits the closure 40 to be readily removed and reinstalled in the refrigerator freezer compartment 21. Applicant's novel structure thus allows ready accessibility to the divider cavity 38 via the access opening 39 for servicing system components therewithin, such as the cooling coil 60, without the supporting frame or sections thereof having to be disassembled or removed from the cabinet.

An additional feature of the invention is shown in FIG. 6 wherein the lower leg 86*e* extends forward from upper leg 86*d* to define a tapered extension 86*p* to provide a lead and guide for inserting the rear edge 99 of the freezer bottom or closure 40 into the rear wall channel 86*b*. It will be further noted that upon initial factory assembly, the support frame may be pre-affixed to the refrigerator liner before the installation of the cover 40. Alternatively, the support frame may be pre-assembled to the closure 40 and the sub-assembly installed as a unit.

While the embodiment of the present invention as herein disclosed constitutes a preferred form, it is to be understood that other forms might be adopted.

The embodiments of the invention in which an exclusive property or previlege is claimed are defined as follows:

1. In combination with a refrigerator cabinet having an outer shell member, a substantially box-like liner nested substantially within said shell member providing rear, side, bottom and top walls defining a food storage chamber, a laterally extending partition assembly within said chamber dividing said chamber into an upper compartment and a lower compartment, said partition assembly including a bottom supporting wall means, said bottom supporting wall means defining with said refrigerator liner rear and side walls a refrigeration system components cavity accessible via an upper access opening, and a closure for the access opening of said cavity including a planar shelf portion adapted to support food in said upper compartment and a forward portion overlying said partition assembly and engageable therewith for retaining said closure adjacent thereto in closing relationship to said cavity, the improvement wherein said shelf portion is supported by a support frame assembly in a slidably removable manner for closing said cavity access opening, said support frame assembly having three sections, the three sections of said support frame assembly being a pair of elongated mirror image first and second side wall sections and a third rear wall section, said first and second side wall sections each having a length substantially coextensive with a longitudinal side dimension of said shelf portion and terminating in a rearward right-angle corner portion, each side wall section defining an inwardly facing channel adapted to slidably receive and support the associated side edge of said shelf portion, means defining a forwardly facing channel extending throughout the length of said rear wall section adapted to receive the rear edge of said shelf portion, said side sections and said rear wall section each having securing flange portions extending upwardly from the upper edge of its associated channel, means engaging said side and rear wall securing flange portions for fixedly retaining said sections to their respective cabinet liner side and rear walls, means defining a forwardly facing channel in each said corner portion adapted to receive an associated rear corner edge of said shelf portion, said rear wall section having a predetermined length such that the free ends thereof are positioned in opposed spaced relation with the inwardly facing free ends of their associated corner portions defining an adjustment gap at each end of said rear wall section, whereby liners of varying interior tolerance dimensions between their side walls may be adjustably accommodated by the gaps of said support frame assembly; one of said wall section flange portions including a wing extending beyond the free end of the section, whereby said section wing telescopically overlaps a portion of the securing flange portion of an adjacent section so as to conceal any gap at said free end due to such adjustable accommodation, the forward portion of said closure being deformable to permit disengagement thereof from said partition assembly to enable the side and rear edges of said shelf portion to be free for sliding movement relative to said frame assembly, thereby permitting said closure to be removed from said cabinet allowing ready accessibility to said cavity via said access opening for servicing components therewithin without the supporting frame or sections thereof having to be removed.

* * * * *